US007743635B2

(12) United States Patent
Jentzsch et al.

(10) Patent No.: US 7,743,635 B2
(45) Date of Patent: Jun. 29, 2010

(54) METHOD AND APPARATUS FOR FORMING A REINFORCING BEAD IN A CONTAINER END CLOSURE

(75) Inventors: Kevin Reed Jentzsch, Arvada, CO (US); Howard Chasteen, Westminster, CO (US); Mark A. Jacober, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 12/348,941

(22) Filed: Jan. 6, 2009

(65) Prior Publication Data

US 2009/0120943 A1 May 14, 2009

Related U.S. Application Data

(62) Division of application No. 11/173,561, filed on Jul. 1, 2005, now Pat. No. 7,506,779.

(51) Int. Cl.
*B21D 3/02* (2006.01)

(52) U.S. Cl. ..... 72/117; 72/94; 72/120; 72/123

(58) Field of Classification Search ..... 72/94, 72/110, 117, 120, 122, 123, 125, 126
See application file for complete search history.

(56) References Cited

U.S. PATENT DOCUMENTS

| | | | |
|---|---|---|---|
| 91,754 | A | 6/1869 | Lawernce |
| 163,747 | A | 5/1875 | Cummings |
| 706,296 | A | 8/1902 | Bradley |
| 766,604 | A | 8/1904 | Dilg |
| 801,683 | A | 10/1905 | Penfold |
| 818,438 | A | 4/1906 | Heindorf |
| 868,916 | A | 10/1907 | Dieckmann |
| 1,045,055 | A | 11/1912 | Mittinger, Jr. |
| 2,060,145 | A | 11/1936 | Vogel |
| 2,318,603 | A | 5/1943 | Erb |
| D141,415 | S | 5/1945 | Wargel et al. |
| 2,759,628 | A | 8/1956 | Sokoloff |
| 2,894,844 | A | 7/1959 | Shakman |
| 3,023,927 | A | 3/1962 | Ehman |
| 3,025,814 | A | 3/1962 | Currie et al. |

(Continued)

FOREIGN PATENT DOCUMENTS

| | | |
|---|---|---|
| CH | 327383 | 1/1958 |

(Continued)

OTHER PUBLICATIONS

Author Unknown, "Brewing Industry Recommended Can Specifications Manual", United States Brewers Assoc., Inc, 1981 (with 1983 revisions), pp. 1-7.

(Continued)

*Primary Examiner*—Edward Tolan
(74) *Attorney, Agent, or Firm*—Sheridan Ross P.C.

(57) ABSTRACT

A metallic container end closure is provided which includes a channel or groove in a predetermined location in at least one of an inner panel wall, outer panel wall, or chuckwall, and which is formed by a shaping tool. An apparatus and method for spin-forming the end closure with the improved geometry is also provided herein.

3 Claims, 8 Drawing Sheets

U.S. PATENT DOCUMENTS

| | | | |
|---|---|---|---|
| 3,105,765 | A | 10/1963 | Creegan |
| 3,176,872 | A | 4/1965 | Zundel |
| 3,208,627 | A | 9/1965 | Lipske |
| 3,251,515 | A | 5/1966 | Henchert et al. |
| 3,268,105 | A | 8/1966 | Geiger |
| D206,500 | S | 12/1966 | Nissen et al. |
| 3,383,748 | A | 5/1968 | Galimberti et al. |
| 3,397,811 | A | 8/1968 | Lipske |
| 3,417,898 | A | 12/1968 | Bozek et al. |
| 3,480,175 | A | 11/1969 | Khoury |
| 3,525,455 | A | 8/1970 | Saunders |
| 3,564,895 | A | 2/1971 | Pfanner et al. |
| 3,650,387 | A | 3/1972 | Hornsby et al. |
| 3,715,054 | A | 2/1973 | Gedde |
| 3,734,338 | A | 5/1973 | Schubert |
| 3,744,667 | A | 7/1973 | Fraze et al. |
| 3,745,623 | A | 7/1973 | Wentorf, Jr. et al. |
| 3,757,716 | A | 9/1973 | Gedde |
| 3,762,005 | A | 10/1973 | Erkfritz |
| 3,765,352 | A | 10/1973 | Schubert et al. |
| D229,396 | S | 11/1973 | Zundel |
| 3,774,801 | A | 11/1973 | Gedde |
| 3,814,279 | A | 6/1974 | Rayzal |
| 3,836,038 | A | 9/1974 | Cudzik |
| 3,843,014 | A | 10/1974 | Cospen et al. |
| 3,868,919 | A | 3/1975 | Schrecker et al. |
| 3,871,314 | A | 3/1975 | Stargell |
| 3,874,553 | A | 4/1975 | Schultz et al. |
| 3,904,069 | A | 9/1975 | Toukmanian |
| 3,967,752 | A | 7/1976 | Cudzik |
| 3,982,657 | A | 9/1976 | Keller et al. |
| 3,983,827 | A | 10/1976 | Meadors |
| 4,015,744 | A | 4/1977 | Brown |
| 4,024,981 | A | 5/1977 | Brown |
| 4,030,631 | A | 6/1977 | Brown |
| 4,031,837 | A | 6/1977 | Jordan |
| 4,037,550 | A | 7/1977 | Zofko |
| 4,043,168 | A | 8/1977 | Mazurek |
| 4,056,871 | A | 11/1977 | Bator |
| 4,087,193 | A | 5/1978 | Mundy |
| 4,093,102 | A | 6/1978 | Kraska |
| 4,109,599 | A | 8/1978 | Schultz |
| 4,116,361 | A | 9/1978 | Stargell |
| 4,126,652 | A | 11/1978 | Oohara et al. |
| 4,127,212 | A | 11/1978 | Waterbury |
| 4,148,410 | A | 4/1979 | Brown |
| 4,150,765 | A | 4/1979 | Mazurek |
| 4,210,257 | A | 7/1980 | Radtke |
| 4,213,324 | A | 7/1980 | Kelley et al. |
| 4,215,795 | A | 8/1980 | Elser |
| 4,217,843 | A | 8/1980 | Kraska |
| 4,271,778 | A | 6/1981 | La Bret |
| 4,274,351 | A | 6/1981 | Boardman |
| 4,276,993 | A | 7/1981 | Hassegaun |
| 4,286,728 | A | 9/1981 | Fraze et al. |
| 4,341,321 | A | 7/1982 | Gombas |
| 4,365,499 | A | 12/1982 | Hirota et al. |
| 4,387,827 | A | 6/1983 | Ruemer, Jr. |
| 4,402,419 | A | 9/1983 | MacPherson |
| 4,420,283 | A | 12/1983 | Post |
| 4,434,641 | A | 3/1984 | Nguyen |
| 4,435,969 | A | 3/1984 | Nichols et al. |
| 4,448,322 | A | 5/1984 | Kraska |
| 4,467,933 | A | 8/1984 | Wilkinson et al. |
| 4,516,420 | A | 5/1985 | Bulso et al. |
| D279,265 | S | 6/1985 | Turner et al. |
| 4,530,631 | A | 7/1985 | Kaminski et al. |
| D281,581 | S | 12/1985 | MacEwen |
| 4,559,801 | A | 12/1985 | Smith et al. |
| 4,563,887 | A | 1/1986 | Bressan et al. |
| 4,571,978 | A | 2/1986 | Taube et al. |
| 4,577,774 | A | 3/1986 | Nguyen |
| 4,578,007 | A | 3/1986 | Diekhoff |
| 4,587,825 | A | 5/1986 | Bulso et al. |
| 4,587,826 | A | 5/1986 | Bulso et al. |
| 4,606,472 | A | 8/1986 | Taube et al. |
| D285,661 | S | 9/1986 | Brownbill |
| 4,641,761 | A | 2/1987 | Smith et al. |
| 4,674,649 | A | 6/1987 | Pavely |
| 4,681,238 | A | 7/1987 | Sanchez |
| 4,685,582 | A | 8/1987 | Pulciani et al. |
| 4,685,849 | A | 8/1987 | Labarge et al. |
| 4,697,972 | A | 10/1987 | Le Bret et al. |
| 4,704,887 | A | 11/1987 | Bachmann et al. |
| 4,713,958 | A | 12/1987 | Bulso, Jr. et al. |
| 4,715,208 | A | 12/1987 | Bulso, Jr. et al. |
| 4,716,755 | A | 1/1988 | Bulso, Jr. et al. |
| 4,722,215 | A | 2/1988 | Taube et al. |
| 4,735,863 | A | 4/1988 | Bachmann et al. |
| 4,781,047 | A | 11/1988 | Bressan et al. |
| 4,790,705 | A | 12/1988 | Wilkinson et al. |
| 4,796,772 | A | 1/1989 | Nguyen |
| 4,804,106 | A | 2/1989 | Saunders |
| 4,808,052 | A | 2/1989 | Bulso, Jr. et al. |
| 4,809,861 | A | 3/1989 | Wilkinson |
| D300,607 | S | 4/1989 | Ball |
| D300,608 | S | 4/1989 | Taylor et al. |
| 4,820,100 | A | 4/1989 | Riviere |
| 4,823,973 | A | 4/1989 | Jewitt et al. |
| 4,832,223 | A | 5/1989 | Kalenak et al. |
| 4,832,236 | A | 5/1989 | Greaves |
| 4,865,506 | A | 9/1989 | Kaminski |
| D304,302 | S | 10/1989 | Dalli et al. |
| 4,885,924 | A | 12/1989 | Claydon et al. |
| 4,890,759 | A | 1/1990 | Scanga et al. |
| 4,893,725 | A | 1/1990 | Ball et al. |
| 4,895,012 | A | 1/1990 | Cook et al. |
| 4,919,294 | A | 4/1990 | Kawamoto |
| RE33,217 | E | 5/1990 | Nguyen |
| 4,930,658 | A | 6/1990 | McEldowney |
| 4,934,168 | A | 6/1990 | Osmanski et al. |
| 4,955,223 | A | 9/1990 | Stodd et al. |
| 4,967,538 | A | 11/1990 | Leftault, Jr. et al. |
| 4,991,735 | A | 2/1991 | Biondich |
| 4,994,009 | A | 2/1991 | McEldowney |
| 4,995,223 | A | 2/1991 | Spatafora et al. |
| 5,016,463 | A | 5/1991 | Johansson et al. |
| 5,026,960 | A | 6/1991 | Slutz et al. |
| 5,027,580 | A | 7/1991 | Hymes et al. |
| 5,042,284 | A | 8/1991 | Stodd et al. |
| 5,046,637 | A | 9/1991 | Kysh |
| 5,064,087 | A | 11/1991 | Koch |
| 5,066,184 | A | 11/1991 | Taura et al. |
| 5,069,355 | A | 12/1991 | Matuszak |
| 5,105,977 | A | 4/1992 | Taniuchi |
| 5,129,541 | A | 7/1992 | Voigt et al. |
| 5,141,367 | A | 8/1992 | Beeghly et al. |
| 5,143,504 | A | 9/1992 | Braakman |
| 5,145,086 | A | 9/1992 | Krause |
| 5,149,238 | A | 9/1992 | McEldowney et al. |
| 5,174,706 | A | 12/1992 | Taniuchi |
| 5,222,385 | A | 6/1993 | Halasz et al. |
| D337,521 | S | 7/1993 | McNulty |
| 5,245,848 | A | 9/1993 | Lee, Jr. et al. |
| 5,289,938 | A | 3/1994 | Sanchez |
| D347,172 | S | 5/1994 | Heynen et al. |
| 5,309,749 | A | 5/1994 | Stodd |
| 5,320,469 | A | 6/1994 | Katou et al. |
| 5,325,696 | A * | 7/1994 | Jentzsch et al. ..... 72/117 |
| 5,355,709 | A | 10/1994 | Bauder et al. |
| 5,356,256 | A | 10/1994 | Turner et al. |
| D352,898 | S | 11/1994 | Vacher |
| 5,381,683 | A | 1/1995 | Cowling |
| D356,498 | S | 3/1995 | Strawser |

| | | | |
|---|---|---|---|
| 5,465,599 | A | 11/1995 | Lee, Jr. |
| 5,494,184 | A | 2/1996 | Noguchi et al. |
| 5,502,995 | A | 4/1996 | Stodd |
| 5,524,468 | A | 6/1996 | Jentzsch et al. |
| 5,527,143 | A | 6/1996 | Turner et al. |
| 5,540,352 | A | 7/1996 | Halasz et al. |
| 5,563,107 | A | 10/1996 | Dubensky et al. |
| 5,582,319 | A | 12/1996 | Heyes et al. |
| 5,590,807 | A | 1/1997 | Forrest et al. |
| 5,598,734 | A | 2/1997 | Forrest et al. |
| 5,612,264 | A | 3/1997 | Nilsson et al. |
| 5,634,366 | A | 6/1997 | Stodd |
| 5,636,761 | A | 6/1997 | Diamond et al. |
| 5,653,355 | A | 8/1997 | Tominaga et al. |
| 5,676,512 | A | 10/1997 | Diamond et al. |
| 5,685,189 | A | 11/1997 | Nguyen et al. |
| 5,697,242 | A | 12/1997 | Halasz et al. |
| 5,706,686 | A | 1/1998 | Babbitt et al. |
| 5,749,488 | A | 5/1998 | Bagwell et al. |
| 5,823,730 | A | 10/1998 | La Rovere |
| 5,829,623 | A | 11/1998 | Otsuka et al. |
| 5,857,374 | A | 1/1999 | Stodd |
| D406,236 | S | 3/1999 | Brifcani et al. |
| 5,911,551 | A | 6/1999 | Moran |
| 5,934,127 | A | 8/1999 | Ihly |
| 5,950,858 | A | 9/1999 | Sergeant |
| 5,957,647 | A | 9/1999 | Hinton |
| 5,969,605 | A | 10/1999 | McIntyre et al. |
| 5,971,259 | A | 10/1999 | Bacon |
| 6,024,239 | A | 2/2000 | Turner et al. |
| 6,033,789 | A | 3/2000 | Saveker et al. |
| 6,055,836 | A | 5/2000 | Waterworth et al. |
| 6,058,753 | A | 5/2000 | Jowitt et al. |
| 6,065,634 | A | 5/2000 | Brifcani et al. |
| 6,089,072 | A | 7/2000 | Fields |
| 6,102,243 | A | 8/2000 | Fields et al. |
| 6,126,034 | A | 10/2000 | Borden et al. |
| 6,131,761 | A | 10/2000 | Cheng et al. |
| 6,234,337 | B1 | 5/2001 | Huber et al. |
| 6,290,447 | B1 | 9/2001 | Siemonsen et al. |
| 6,296,139 | B1 | 10/2001 | Hanafusa et al. |
| D452,155 | S | 12/2001 | Stodd |
| 6,386,013 | B1 | 5/2002 | Werth |
| 6,408,498 | B1 | 6/2002 | Fields et al. |
| 6,419,110 | B1 | 7/2002 | Stodd |
| 6,425,493 | B1 | 7/2002 | Gardiner |
| 6,425,721 | B1 | 7/2002 | Zysset |
| 6,428,261 | B1 | 8/2002 | Zysset |
| 6,460,723 | B2 | 10/2002 | Nguyen et al. |
| 6,499,622 | B1 | 12/2002 | Neiner |
| 6,516,968 | B2 | 2/2003 | Stodd |
| 6,526,799 | B2 | 3/2003 | Ferraro et al. |
| 6,561,004 | B1 | 5/2003 | Neiner et al. |
| 6,616,393 | B1 | 9/2003 | Jentzsch |
| D480,304 | S | 10/2003 | Stodd |
| 6,634,837 | B1 | 10/2003 | Anderson |
| 6,658,911 | B2 | 12/2003 | McClung |
| 6,702,142 | B2 | 3/2004 | Neiner |
| 6,702,538 | B1 | 3/2004 | Heinicke et al. |
| 6,736,283 | B1 | 5/2004 | Santamaria et al. |
| 6,748,789 | B2 | 6/2004 | Turner et al. |
| 6,761,280 | B2 | 7/2004 | Zonker et al. |
| 6,772,900 | B2 | 8/2004 | Turner et al. |
| 6,837,089 | B2 | 1/2005 | Jentzsch et al. |
| 6,848,875 | B2 | 2/2005 | Brifcani et al. |
| 6,877,941 | B2 | 4/2005 | Brifcani et al. |
| 6,915,553 | B2 | 7/2005 | Turner et al. |
| 6,935,826 | B2 | 8/2005 | Brifcani et al. |
| 6,959,577 | B2 | 11/2005 | Jentzsch |
| 6,968,724 | B2 | 11/2005 | Hubball |
| 7,004,345 | B2 | 2/2006 | Turner et al. |
| 7,100,789 | B2 | 9/2006 | Nguyen et al. |
| 7,125,214 | B2 | 10/2006 | Carrein et al. |
| 7,174,762 | B2 | 2/2007 | Turner et al. |
| 7,263,868 | B2 | 9/2007 | Jentzsch et al. |
| 7,341,163 | B2 | 3/2008 | Stodd |
| 7,350,392 | B2 | 4/2008 | Turner et al. |
| 7,370,774 | B2 | 5/2008 | Watson et al. |
| 7,380,684 | B2 | 6/2008 | Reed et al. |
| 7,500,376 | B2 | 3/2009 | Bathurst et al. |
| 7,506,779 | B2 | 3/2009 | Jentzsch et al. |
| 2001/0037668 | A1 | 11/2001 | Fields |
| 2002/0139805 | A1 | 10/2002 | Chasteen et al. |
| 2002/0158071 | A1 | 10/2002 | Chasteen et al. |
| 2003/0177803 | A1 | 9/2003 | Golding et al. |
| 2003/0198538 | A1 | 10/2003 | Brifcani et al. |
| 2004/0026433 | A1 | 2/2004 | Brifcani et al. |
| 2004/0026434 | A1 | 2/2004 | Brifcani et al. |
| 2004/0052593 | A1 | 3/2004 | Anderson |
| 2004/0140312 | A1 | 7/2004 | Neiner |
| 2004/0238546 | A1 | 12/2004 | Watson et al. |
| 2005/0029269 | A1 | 2/2005 | Stodd |
| 2005/0115976 | A1 | 6/2005 | Watson et al. |
| 2005/0247717 | A1 | 11/2005 | Brifcani et al. |
| 2005/0252922 | A1 | 11/2005 | Reed et al. |
| 2006/0010957 | A1 | 1/2006 | Hubball |
| 2006/0071005 | A1 | 4/2006 | Bulso |
| 2009/0020543 | A1 | 1/2009 | Bulso |

FOREIGN PATENT DOCUMENTS

| | | |
|---|---|---|
| DE | 734942 | 5/1943 |
| DE | 9211788 | 1/1993 |
| EP | 0049020 | 4/1982 |
| EP | 0139282 | 5/1985 |
| EP | 0153115 | 8/1985 |
| EP | 0340955 | 11/1989 |
| EP | 0348070 | 12/1989 |
| EP | 0482581 | 4/1992 |
| EP | 0828663 | 12/1999 |
| EP | 1361164 | 11/2003 |
| FR | 917771 | 1/1947 |
| GB | 767029 | 1/1957 |
| GB | 2196891 | 5/1988 |
| GB | 2218024 | 11/1989 |
| GB | 2315478 | 2/1998 |
| JP | 49-096887 | 9/1974 |
| JP | 50-144580 | 11/1975 |
| JP | 54-074184 | 6/1979 |
| JP | 55-122945 | 9/1980 |
| JP | 56-53835 | 5/1981 |
| JP | 56-53836 | 5/1981 |
| JP | 56-107323 | 8/1981 |
| JP | 57-44435 | 3/1982 |
| JP | 57-94436 | 6/1982 |
| JP | S57-117323 | 7/1982 |
| JP | 58-035028 | 3/1983 |
| JP | 58-35029 | 3/1983 |
| JP | 59-144535 | 8/1984 |
| JP | 61-023533 | 2/1986 |
| JP | 63-125152 | 5/1988 |
| JP | 1-167050 | 6/1989 |
| JP | 1-170538 | 7/1989 |
| JP | 1-289526 | 11/1989 |
| JP | 2-092426 | 4/1990 |
| JP | 2-131931 | 5/1990 |
| JP | 2-192837 | 7/1990 |
| JP | 3-032835 | 2/1991 |
| JP | 3-275443 | 12/1991 |
| JP | 4-033733 | 2/1992 |
| JP | 4-055028 | 2/1992 |
| JP | 5-532255 | 2/1993 |
| JP | 5-112357 | 5/1993 |
| JP | H5-112357 | 5/1993 |
| JP | 5-185170 | 7/1993 |
| JP | 6-127547 | 5/1994 |

| | | |
|---|---|---|
| JP | 6-179445 | 6/1994 |
| JP | 7-171645 | 7/1995 |
| JP | 8-168837 | 7/1996 |
| JP | 8-192840 | 7/1996 |
| JP | 2000-109068 | 4/2000 |
| WO | WO 83/02577 | 8/1983 |
| WO | WO 89/10216 | 11/1989 |
| WO | WO 93/17864 | 9/1993 |
| WO | WO 96/37414 | 11/1996 |
| WO | WO 98/34743 | 8/1998 |
| WO | WO 00/12243 | 3/2000 |
| WO | WO 00/64609 | 11/2000 |
| WO | WO 01/41948 | 6/2001 |
| WO | WO 02/43895 | 6/2002 |
| WO | WO 02/068281 | 9/2002 |
| WO | WO 03/059764 | 7/2003 |
| WO | WO 2005/032953 | 4/2005 |
| WO | WO 2007/005564 | 1/2007 |

OTHER PUBLICATIONS

Author Unknown, "Beverage Can, End, & Double Seam Dimensional Specifications", Society of Soft Drink Technologists, Aug. 1993, pp. 1-6.

Author Unknown, "Guideline Booklet of the Society of Soft Drink Technologists", Jun. 5, 1986, pp. 1-21.

Supplementary European Search Report for European Application No. 06785923.1, dated Aug. 24, 2009.

* cited by examiner

METHOD AND APPARATUS FOR FORMING A REINFORCING BEAD IN A CONTAINER END CLOSURE

This application is a Divisional of patent application Ser. No. 11/173,561, filed Jul. 1, 2005, now U.S. Pat No. 7,506,779,the entire disclosure of which is incorporated by reference herein.

FIELD OF THE INVENTION

The present invention relates to a method and apparatus for utilizing a spin forming tool to form a distinct geometric shape in a container end closure which is adapted for interconnection to a container neck and which has improved strength and buckle resistance.

BACKGROUND OF THE INVENTION

Containers, and more specifically metallic beverage containers, are typically manufactured by interconnecting a beverage can end closure on a beverage container body. In some applications, an end closure may be interconnected on both a top side and a bottom side of a can body. More frequently, however, a beverage can end closure is interconnected on a top end of a beverage can body which is drawn and ironed from a flat sheet of blank material such as aluminum. Due to the potentially high internal pressures generated by carbonated beverages, both the beverage can body and the beverage can end closure are typically required to sustain internal pressures exceeding 90 psi without catastrophic and permanent deformation. Further, depending on various environmental conditions such as heat, over fill, high CO2 content, and vibration, the internal pressure in a typical beverage can may at times exceed 100 psi. Thus, beverage can bodies and end closures must be durable to withstand high internal pressures, yet manufactured with extremely thin and durable materials such as aluminum to decrease the overall cost of the manufacturing process and the weight of the finished product.

Accordingly, there exists a significant need for a durable beverage container end closure which can withstand the high internal pressures created by carbonated beverages, and the external forces applied during shipping, yet which is made from a durable, lightweight and extremely thin metallic material with a geometric configuration which reduces material requirements. Previous attempts have been made to provide beverage container end closures with unique geometric configurations to provide material savings and improve strength. One example of such an end closure is described in U.S. Pat. No. 6,065,634 To Crown Cork and Seal Technology Corporation, entitled "Can End and Method for Fixing the Same to a Can Body". Other inventions known in the art have attempted to improve the strength of container end closures and save material costs by improving the geometry of the countersink region. Examples of these patents are U.S. Pat. Nos. 5,685,189 and 6,460,723 to Nguyen et al, which are incorporated herein in their entirety by reference. Another pending application which discloses other improved end closure geometry is disclosed in pending U.S. patent application Ser. No. 10/340,535, which was filed on Jan. 10, 2003 and is further incorporated herein in its entirety by reference. Finally, the assignee of the present application owns another pending application related to reforming and reprofiling a container bottom, which is disclosed in pending U.S. patent Ser. No. 11/020,944 and which is further incorporated herein by reference in its entirety.

The following disclosure describes an improved container end closure which is adapted for interconnection to a container body and which has an improved countersink, chuck wall geometry, and unit depth which significantly saves material costs, yet can withstand significant internal pressures.

Previous methods and apparatus used to increase the strength of a container end closure have generally been attempted using traditional forming presses, which utilize a sequence of tooling operations in a reciprocating press to create a specific geometry. Unfortunately with the use of small gauge aluminum and other thin metallic materials, it has become increasingly difficult to form a preferred geometry without quality control issues as a result of the physical properties of the end closure and the difficulty of retaining a desired shape. Furthermore, when a thin metallic material is worked in a traditional forming press, certain portions of the end closure may be thinned, either from stretching, bending operations, commonly known as "coining". When excessive thinning occurs, the overall strength and integrity of the end closure may be compromised. Further, it is practically impossible to form certain geometries with a typical die press. Thus, there is a significant need in the industry for a new method and apparatus for forming a preferred shape in an end closure, and which uses rollers and other mechanical devices which can form a preferred shape in the end closure without requiring traditional forming presses and the inherent problems related thereto.

Furthermore, new end closure geometries are needed which have distinct shapes and provide superior strength and buckle resistance when interconnected to pressurized containers. As previously mentioned these geometries are typically not feasible using traditional end closure manufacturing techniques. Thus, there is a significant need for new end closure geometries which have improved strength characteristics and which are capable of being formed with thin walled metallic materials.

SUMMARY OF THE INVENTION

It is thus one aspect of the present invention to provide an improved method and apparatus for forming one or more reinforcing beads or other geometric shapes in a container end closure. Thus, in one aspect of the present invention, one or more shaping rollers are utilized to spin-form a portion of an interior or exterior wall portion of a chuck wall or an end closure countersink to provide improved strength characteristics and potential material savings. As used herein, the term "spin-form" may also be referred to as "reform" or "reprofile" and may generally be defined as a process to alter the geometric profile of a container end closure. In one embodiment, a method for changing the geometry of a metal end closure is provided, comprising:

A method for creating a preferred geometry of a metallic end closure which is adapted for interconnection to a neck of a container, comprising:

a) providing a metallic end closure comprising a peripheral cover hook, a chuck-wall extending downwardly therefrom, a countersink having an outer panel wall interconnected to a lower end of the chuck wall, and an inner panel wall interconnected to a central panel;

b) providing a shaping tool which rotates around a central axis, said shaping tool in having an outer surface with a predetermined shape;

c) positioning said outer surface of said shaping tool in contact with at least one of the inner panel wall, the outer panel wall and the chuck wall, wherein a predetermined shape is created in said end closure when said shaping tool engages said metallic end closure.

In another aspect of the present invention the shaping rollers are interconnected to an apparatus which rotates about a given axis which allows the shaping rollers to be positioned against the end closure to create a preferred shape. Alternatively, the end closure is rotated about one or more shaping rollers, which are substantially stationary. Thus, it is another aspect of the present invention to provide an apparatus for forming a preferred geometry in a metallic end closure by utilizing a tool which rotates around a substantially stationary end closure, comprising:

a means for retaining said end closure in a substantially stationary position;

a container spin-forming assembly comprising a roller block aligned in opposing relationship to the end closure, said roller block having an outer annular edge and a leading surface;

a rotating means for rotating said spin-forming assembly;

a pair of reform rollers which project outwardly from said roller block leading surface and which are operably sized to engage an inner panel wall of the end closure of the container; and a biasing means operably interconnected to said pair of reform rollers, wherein when a force is applied to an annular flange on said pair of reform rollers by the end closure, said reform rollers extend outwardly toward said outer annular edge of said roller block, wherein a preferred geometric profile is created on the inner panel wall of the end closure.

It is another aspect of the present invention to provide improved end closure geometries which can be obtained utilizing the aforementioned apparatus and method and which are generally not obtainable using commonly known die presses. In one embodiment, one or more inwardly or outwardly extending reinforcing beads are formed in the chuck wall or inner or outer panel walls of the countersink to create a desired shape in a container end closure. More specifically, a metallic end closure adapted for interconnection to a sidewall of a container body is provided, comprising:

a peripheral cover hook;

a chuck wall extending downwardly from said peripheral cover hook;

a countersink comprising an outer panel wall interconnected to a lower end of said chuck wall and an inner panel interconnected to a central panel; and a channel with a predetermined geometric profile positioned in at least one of said inner panel or said outer panel of said countersink, wherein the distance between said inner panel wall and outer panel wall at said channel is less than the distance between the outer panel wall and the lower panel wall in a lower portion of the countersink.

Figure 1:
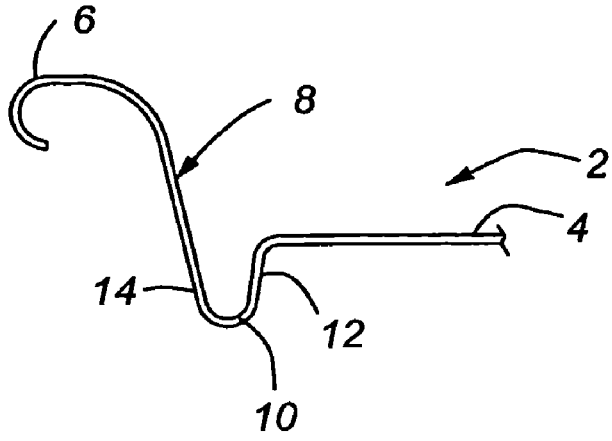
FIG. 1 is a front cross-sectional elevation view of one embodiment of the invention shown before reforming or spin-forming.

For clarity, the following is a list of components generally shown in the drawings:

| No. | Components |
|---|---|
| 2 | End closure |
| 4 | Central panel |
| 6 | Peripheral cover hook |
| 8 | Chuck wall |
| 10 | Countersink |
| 12 | Countersink inner panel wall |
| 14 | Countersink outer panel wall |
| 16 | Channel |
| 18 | Container |
| 20 | Container neck |
| 22 | Double seam |
| 24 | Panel radius |
| 26 | Inside reform radius |
| 28 | Outside reform radius |
| 30 | Reform gap |
| 32 | Spin forming assembly |
| 34 | Roller block |
| 36 | Reform Rollers |
| 38 | Roller block leading surface |
| 40 | Roller block central aperture |
| 42 | Mounting shaft |
| 44 | Reprofile rollers |

DETAILED DESCRIPTION

Referring now to FIGS. 1 through 11, various embodiments of the present invention are provided herein. More specifically, FIG. 1 depicts a typical beverage container end closure shell shown before a reforming or "spin-forming"

procedure has been performed. More specifically, the end closure 2 is generally comprised of a peripheral cover hook 6, a chuck wall 8 which extends from the peripheral cover hook 6 and which is interconnected to a countersink 10 on a lower end. The countersink 10 is generally comprised of an inner panel wall 12 and an outer panel wall 14, and wherein the inner panel wall 12 is interconnected to the central panel 4.

Figure 2:
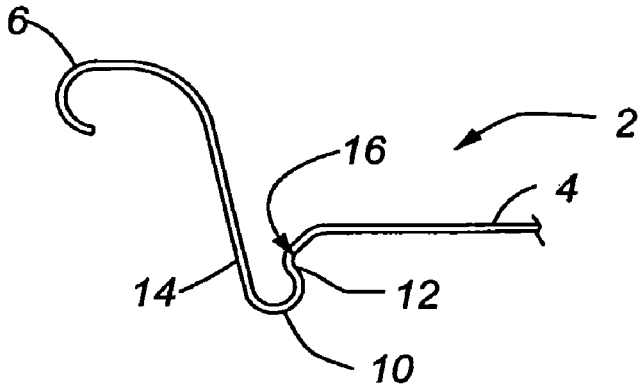
FIG. 2 is a front cross-sectional elevation view of the embodiment shown in FIG. 1 and showing inside reforming wherein a channel is positioned on an inner panel wall.
Figure 2A:
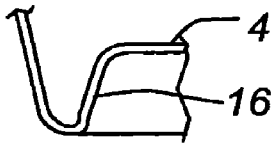
FIG. 2A is a front cross-sectional elevation view showing a variation of the reforming shown in FIG. 2.

Referring now to FIG. 2, the end closure of FIG. 1 is shown after an inner panel wall reforming or spin-forming procedure has been performed. More specifically, after the positioning of the inside reforming tool, a channel 16 is formed in the inner panel wall of the countersink, thus changing the geometric profile and in this particular embodiment providing a channel radius of approximately 0.035 inches. As appreciated by one skilled in the art, the actual geometric configuration and/or size of the channel 16 is not critical to the present invention, but rather the novelty in one embodiment relates to the method of forming the channel 16 in the various geometries which can be obtained using this method which are impractical or impossible to perform in a typical die press. Based on these novel methods and the apparatus used for form these geometries, unique and novel end closure geometries can be formed which are not possible with typical die presses. In one embodiment, it is anticipated that the channel on either the inner panel wall 12 or outer panel wall 14 may have a radius of between about 0.005-0.035 inches. Referring now to FIG. 2A, a slight variation of the geometry shown in FIG. 2 is provided herein, and wherein the inner panel wall has a distinct shape positioned near a lowermost portion of the countersink, and which is entirely different than the embodiment shown in FIG. 2.

Figure 3:
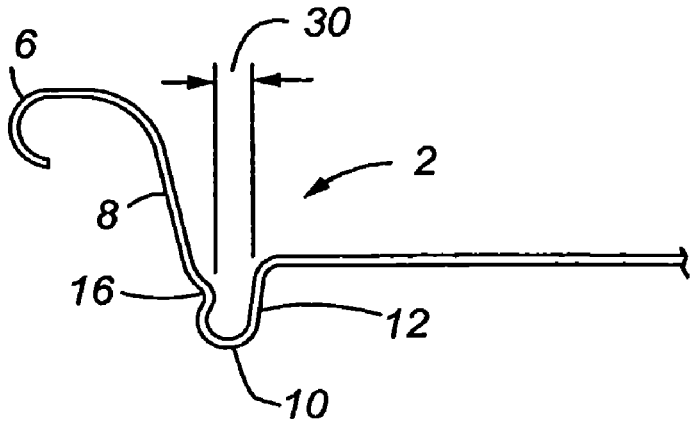
FIG. 3 is a cross-sectional front elevation view of an alternative embodiment of the present invention, wherein an outer panel wall is reformed.
Figure 3A:
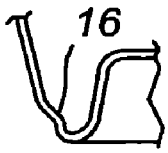
FIG. 3A is a cross-sectional front elevation view depicting a variation of the embodiment shown in FIG. 3.

Referring now to FIGS. 3 and 3A, an alternative embodiment of the present invention is provided herein, wherein the channel 16 is positioned on an outer panel wall of the countersink 10. FIG. 3A represents a variation of the embodiment shown in FIG. 3, wherein the geometry is distinct and the channel 16 is not as pronounced as the embodiment shown in FIG. 3, and is positioned on a lower portion of the outer panel wall 16. As further shown in FIG. 3, depending on the depth of the channel 16, a reform gap 30 is created and which may have a dimension of between about 0.070-0.005 inches. Alternatively, the reform gap 30 may be eliminated altogether by creating a deep channel 16.

Figure 4:
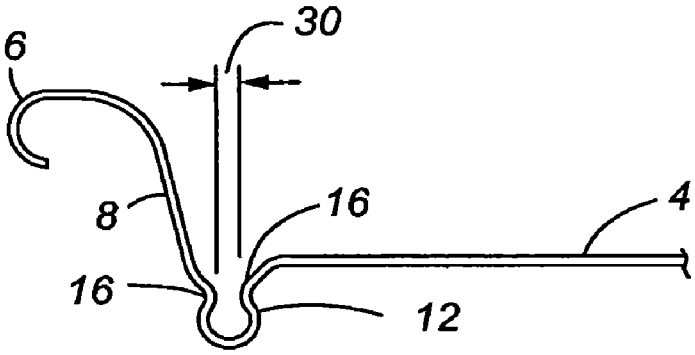
FIG. 4 is a cross-sectional front elevation view showing a shell end closure which has been reformed on both an inside panel wall and outside panel wall.

Referring now to FIG. 4, an alternative embodiment of the present invention is provided herein, wherein both the inner panel wall 12 and outer panel wall 14 of the end closure 2 have been reformed to create a channel 16 which substantially oppose each other. Although in this embodiment a reform gap 30 is provided, as mentioned above, the channel on the inner panel wall and/or an outer panel wall may be deep enough to completely eliminate the gap 30, and wherein the inner panel wall and outer panel are in contact with each other. In either embodiment, the diameter between the channels 16 is less than the diameter between the lowermost portion of the inner panel wall 12 and outer panel wall 14.

Figure 5:
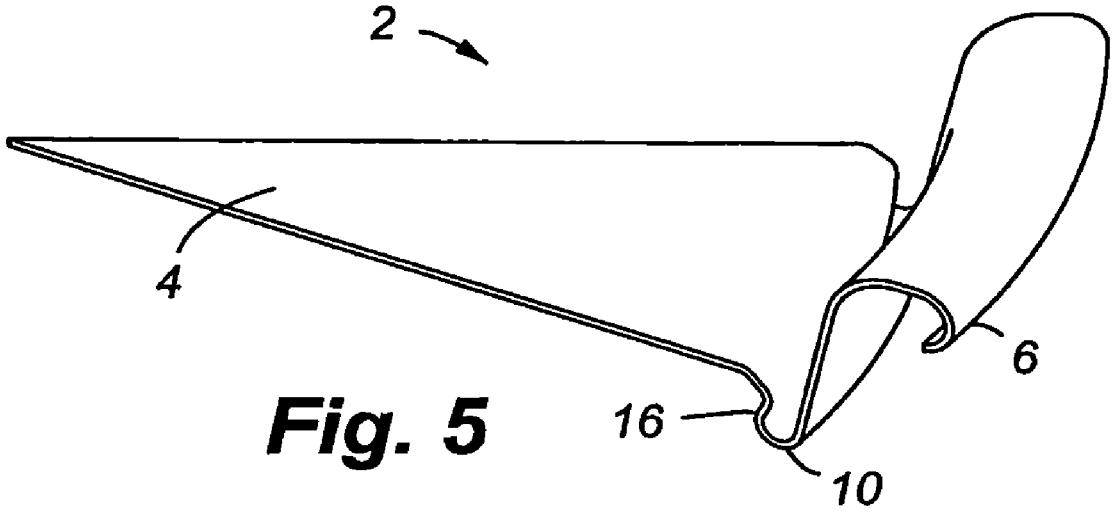
FIG. 5 is a front perspective view of one embodiment of the present invention showing the inner panel wall reformed.
Figure 6:
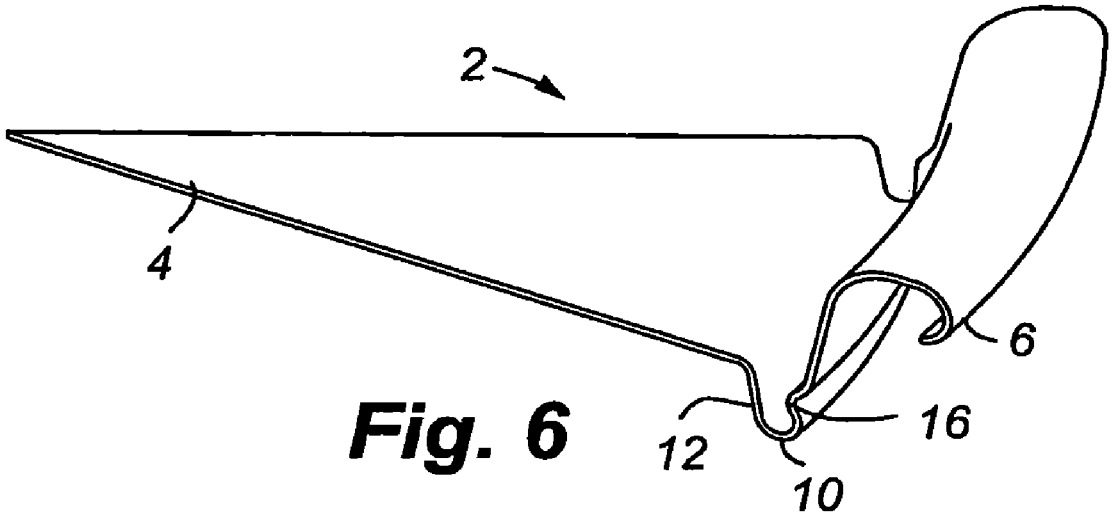
FIG. 6 is a front perspective view of an alternative embodiment of the present invention showing an outer panel wall reformed.
Figure 7:
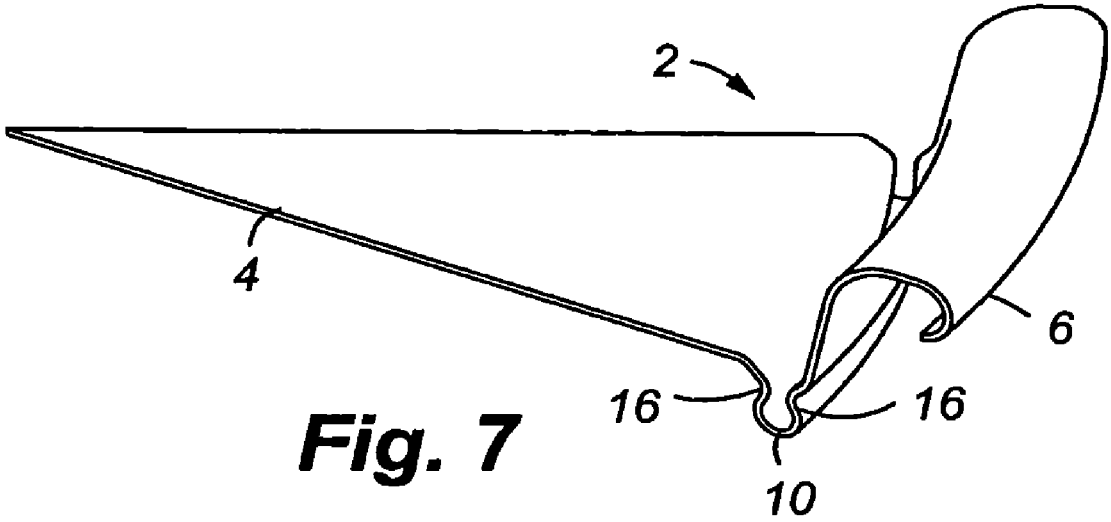
FIG. 7 is a front perspective view of an alternative embodiment of the present invention wherein both the inner panel wall and outer panel wall have been reformed.

Referring now to FIGS. 5-7, front perspective views of alternative embodiments of the present invention are provided herein. More specifically, FIG. 5 is an embodiment showing an end closure 2 having a channel 16 positioned on the inner panel wall, while FIG. 6 is a front cut-away perspective view showing the channel 16 positioned on the outer panel wall of the countersink 10. Alternatively, FIG. 7 is a cross-sectional front perspective view showing a channel 16 positioned on both the inner panel wall and the outer panel wall of the countersink 10.

Figure 8:
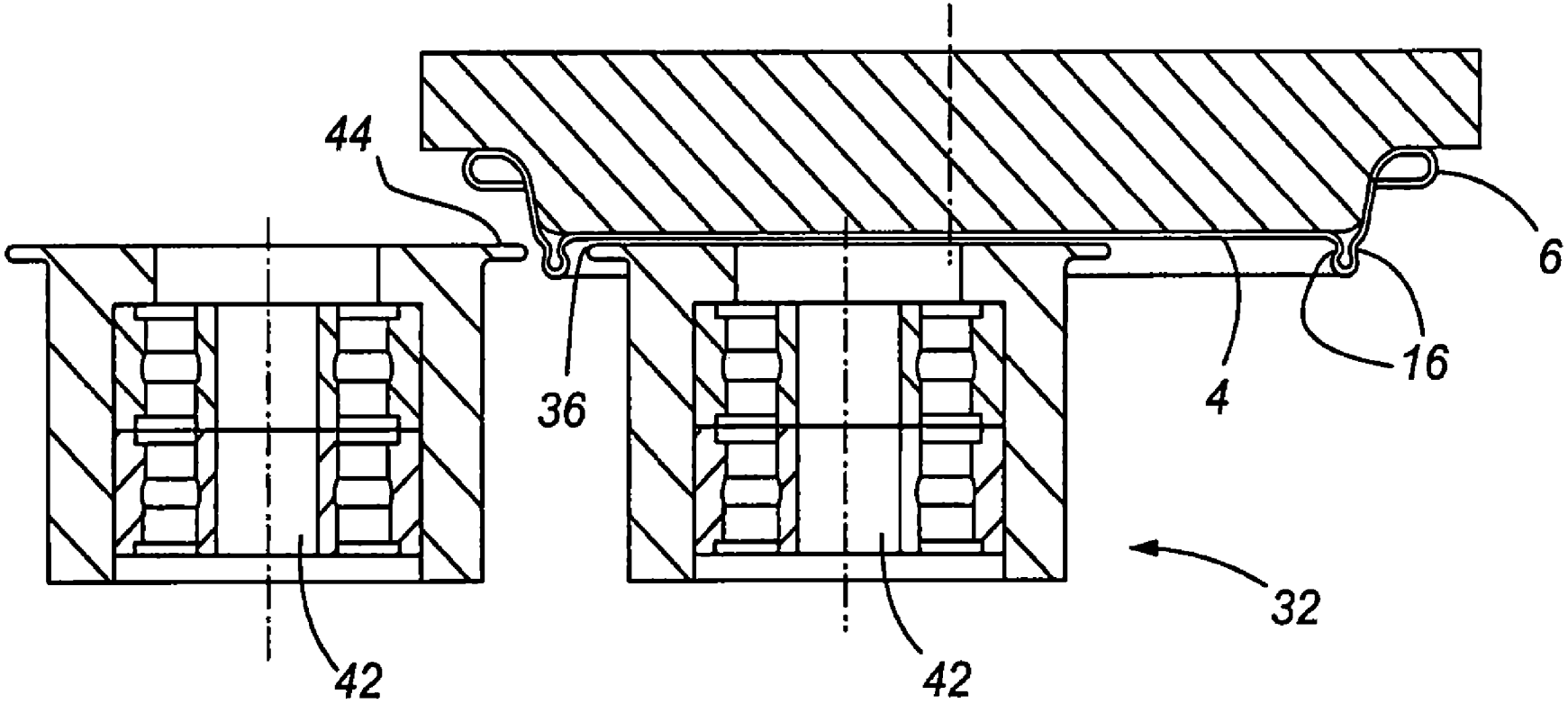
FIG. 8 is a front cross-sectional elevation view showing a container end closure after both the inner panel wall and outer panel wall have been reformed and further depicting a reforming assembly.

Referring now to FIG. 8, a cross-sectional front elevation view is provided which further depicts one embodiment of a dual reforming or spin-forming assembly 32 used to shape the end closure 2 to a desired geometric profile. As provided herein, the term "reform" or "spin-forming" may describe changing the geometric profile of the inner panel wall and/or outer panel wall or both, or the term "reprofiling" may additionally be used to describe the same process. In the drawing shown in FIG. 8, reform rollers 36 are shown after engagement with the inner panel wall of the countersink, while reprofile rollers 44 are shown just after engagement with the outer panel wall of the end closure 2 to create a preferred geometric shape 42. In one embodiment, the reform rollers and reprofile rollers 44 are interconnected to a mounting shaft 42 and roller block assembly 32 which is used to support and spin the roller block end or reprofile rollers 44.

Figure 9:
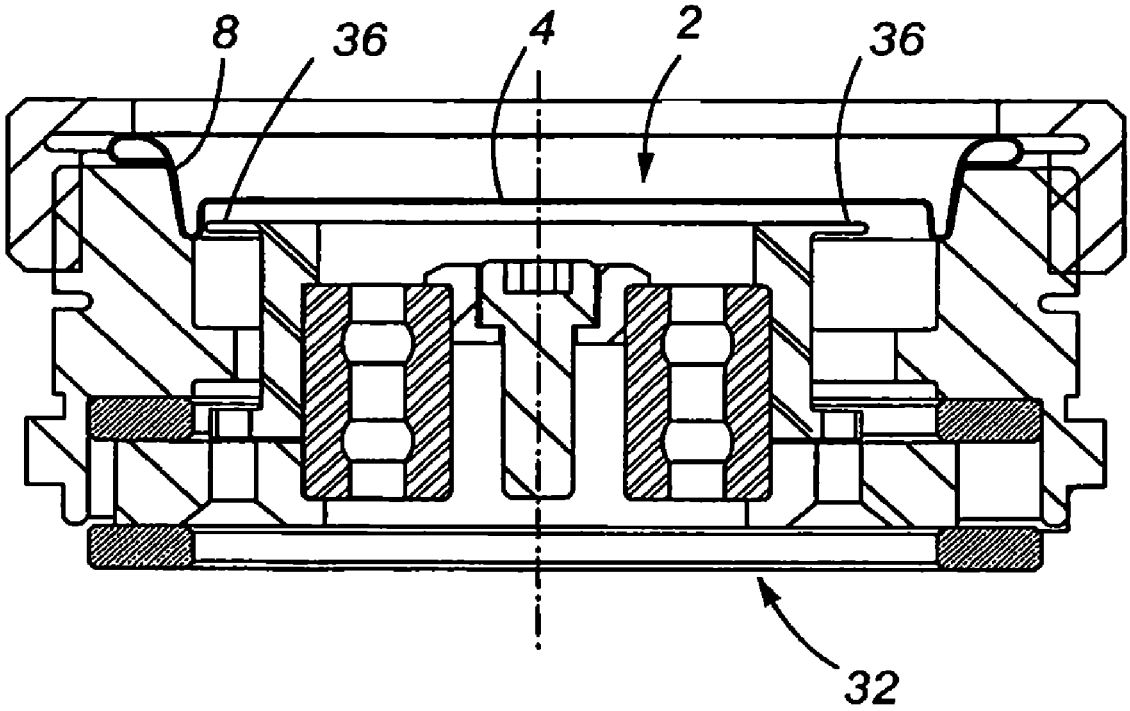
FIG. 9 is a cross-sectional front elevation view further showing the components of one embodiment of a reforming tool prior to positioning a channel in an inner panel wall of an end closure.

Referring now to FIG. 9, an alternative embodiment of the present invention is shown wherein a roller block reforming and reprofiling assembly 32 is shown in an opposing position to an end closure 2, and just prior to preparing a channel 16 in the inner panel wall of the countersink. As previously mentioned, depending on the geometric profile of the reform rollers 36, the geometry and depth of the channel 16 can be any size and dimension depending on the performance criteria of the end closure 2.

Figure 10A:
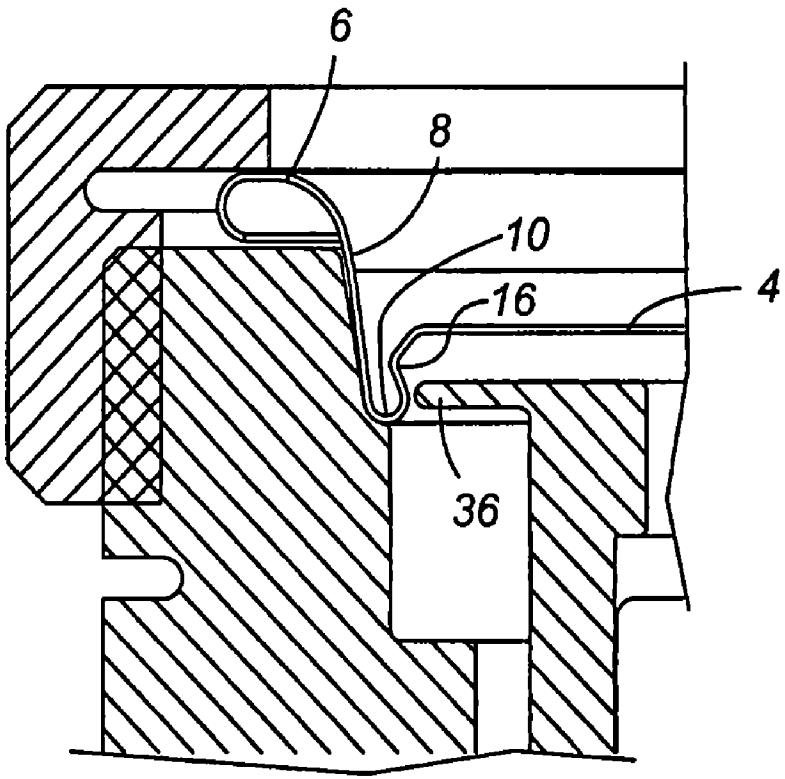
FIG. 10A is a front cross-sectional view of the embodiment shown in FIG. 10A and after a reforming channel has been positioned in an inner panel wall.
Figure 10:
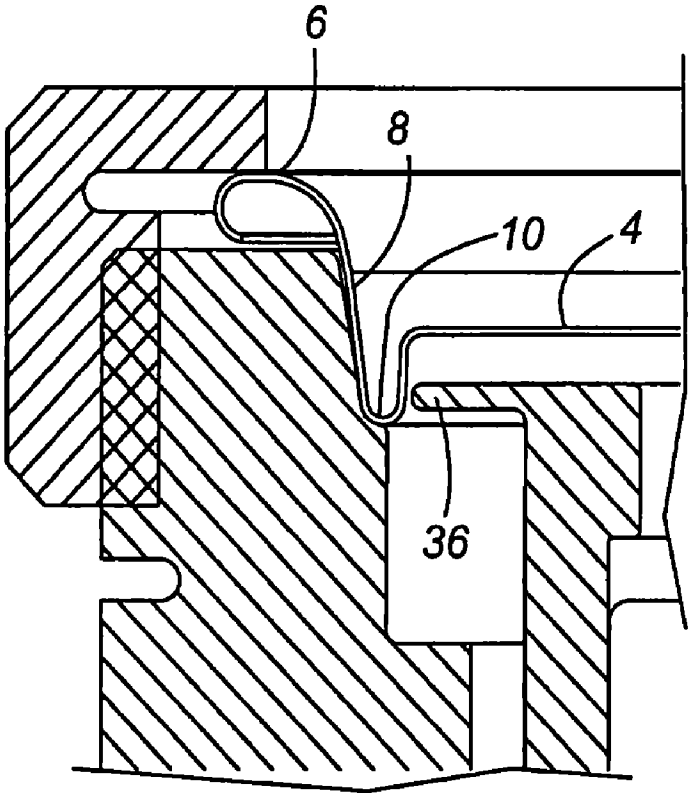
FIG. 10 is a cross-sectional front elevation view showing a container end closure positioned opposite a reforming tool and just prior to reforming.

Referring now to FIGS. 10 and 10A, cross-sectional front elevation views are provided which show additional detail of the reform rollers 36 just prior to reforming in FIG. 10 and after reforming in FIG. 10A. As shown, after the reform roller 36 is placed in contact with the inner panel wall of the end closure 2, a channel 16 is created between the central panel 4 and the countersink 10. The end closure 2 is generally held stationary while the reform rollers 36 spin, although alternatively the reform rollers 36 can be held stationary while the end closure 2 is spun around an axis which is substantially parallel to the drive shaft of the reform assembly or perpendicular to the drive shaft assembly.

Figure 11:
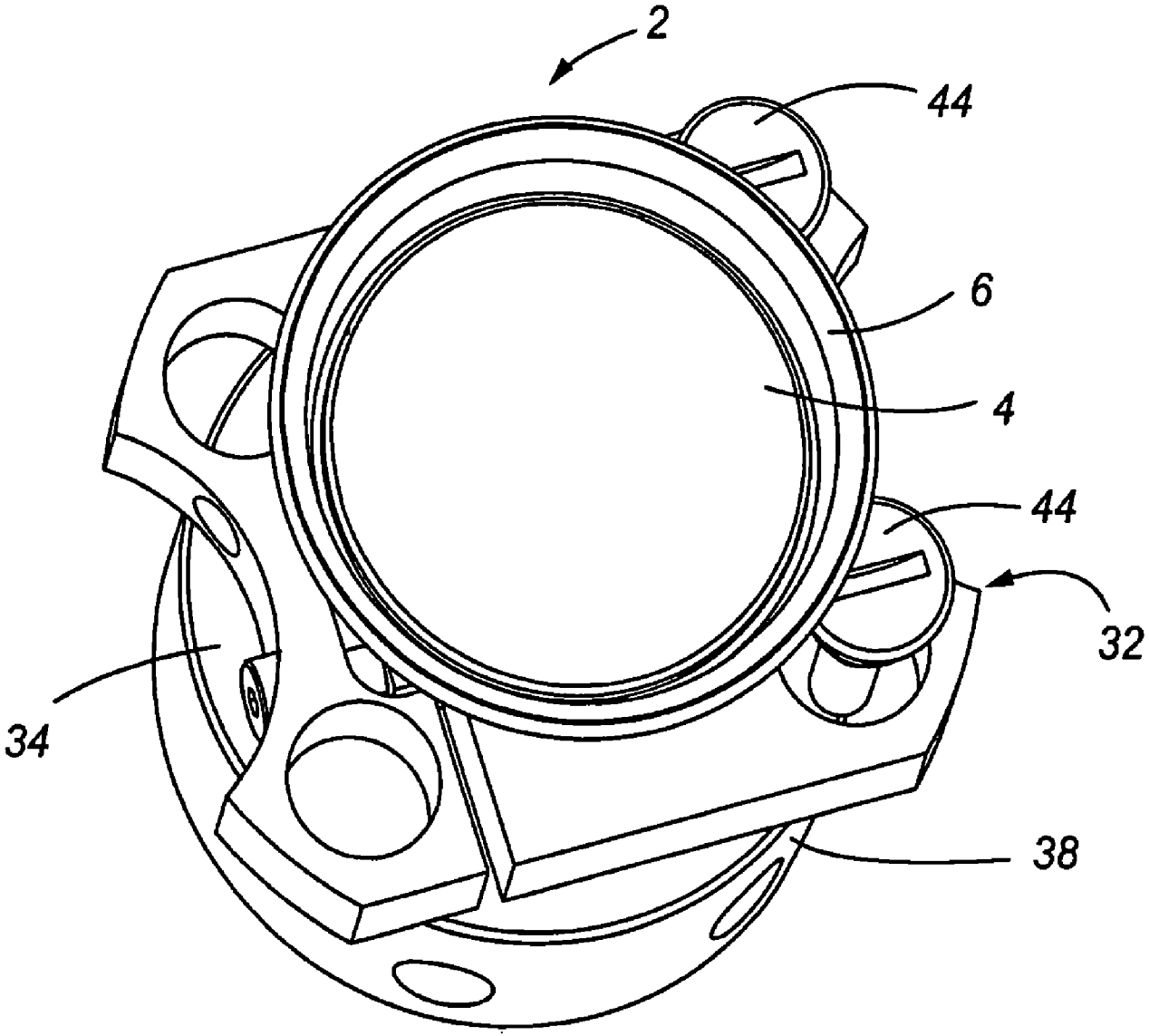
FIG. 11 is a top front perspective view of a container end closure positioned on top of a spin-forming assembly and depicting the reprofile rollers in operable contact with an outer panel wall of a container end closure.

Referring now to FIG. 1, a front perspective view of one embodiment of the present invention is provided herein and which more clearly shows a roller block 34, a roller block leading surface 38, and the reprofile rollers 44 positioned in opposing relationship to the end closure 2. Although FIG. 11 depicts two reprofile rollers 44 interconnected to the roller block 34, as appreciated by one skilled in the art, as few as one and as many as four or five reform rollers and/or reprofile or spin-form rollers can be used to provide a preferred geometry in a container end closure.

Figure 12:
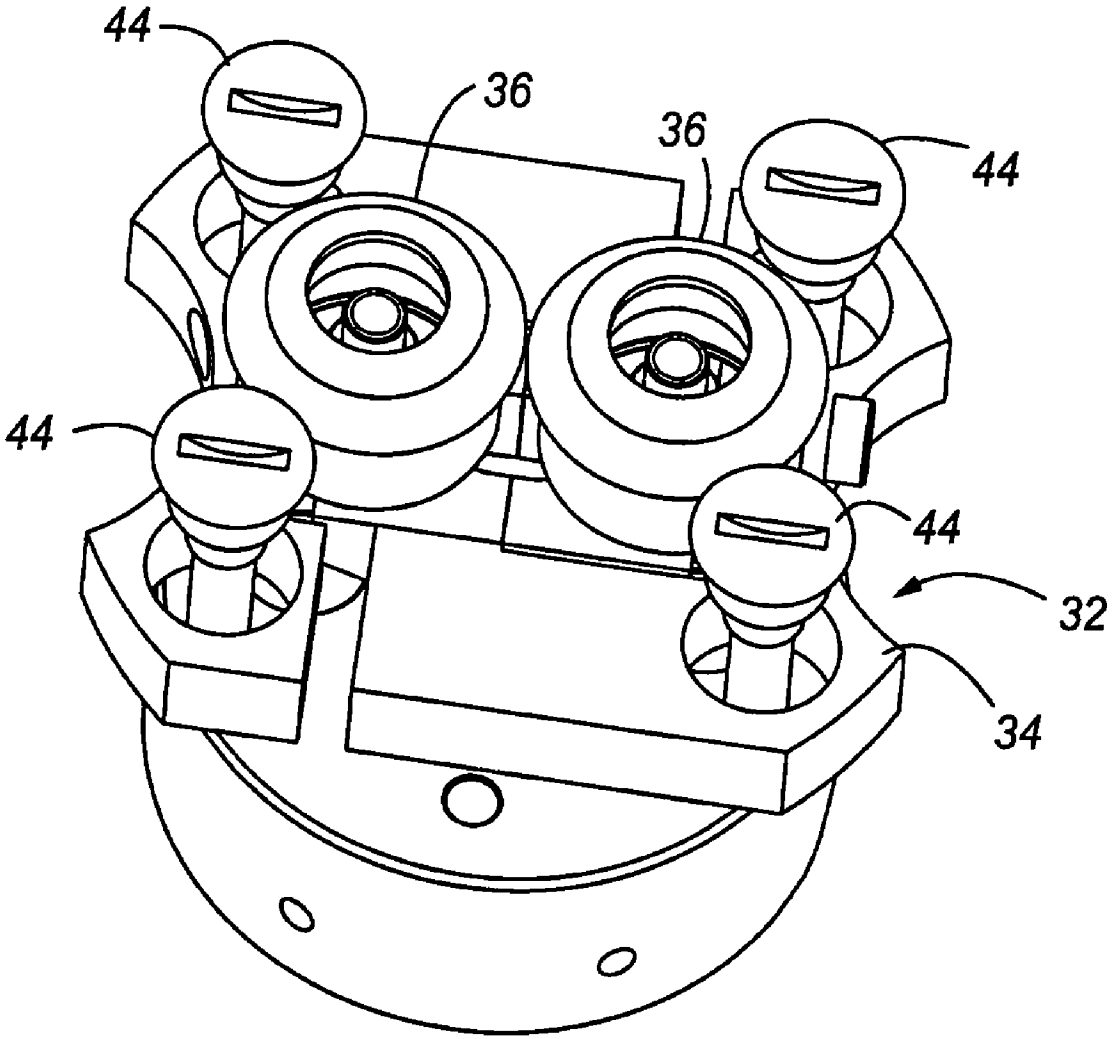
FIG. 12 is an alternative embodiment of the spin-forming assembly of FIG. 11, and depicting two interior reform rollers and four reprofile rollers.

FIG. 12 depicts an alternative embodiment of a spin-rolling apparatus 32, and which is shown without an end closure engaged thereto. As generally shown, the spin-forming apparatus in this embodiment includes two reform rollers 36 which are designed to move outwardly, and four reprofile rollers 44 which are generally designed to engage an outer panel wall of an end closure during a spin-forming operation.

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. An apparatus for reshaping a metallic end closure which is adapted for interconnection to a neck of a container, comprising:

a means for retaining said end closure in a substantially stationary position that includes a mandrel that is adapted to frictionally engage at least a portion of a central panel of the end closure;

a container spin-forming assembly comprising a roller block aligned in opposing relationship to the end closure, said roller block having an outer annular edge and a leading surface;

a rotating means for rotating said spin-forming assembly;

a pair of reform rollers which project inwardly from said roller block leading surface and which are operably sized to engage an inner panel wall of the end closure of the container;

a biasing means operably interconnected to said pair of reform rollers, wherein when a force is applied to an annular flange on said pair of reform rollers by the end closure, said reform rollers extend outwardly toward said outer annular edge of said roller block, wherein a preferred geometric profile is created on the inner panel wall of the end closure; and a pair of reprofiling rollers that are interconnected to the rotating means and are adapted to engage an outer panel wall of the end closure.

2. The apparatus of claim 1, wherein said rotating means comprises a motor.

3. The apparatus of claim 1, wherein said biasing means comprises at least one of a spring and a bearing.

* * * * *